US010294678B2

(12) United States Patent
Kensap

(10) Patent No.: US 10,294,678 B2
(45) Date of Patent: May 21, 2019

(54) DEVICE FOR SMOOTHING OF VISCOSE BUILDING MATERIAL

(71) Applicant: Okei Meistrid OÜ, Kaerepere küla (EE)

(72) Inventor: Silver Kensap, Kaerepere küla (EE)

(73) Assignee: Okei Meistrid OÜ, Kaerepere küla (EE)

( * ) Notice: Subject to any disclaimer, the term of this patent is extended or adjusted under 35 U.S.C. 154(b) by 87 days.

(21) Appl. No.: 15/521,739

(22) PCT Filed: Apr. 30, 2015

(86) PCT No.: PCT/EE2015/000003
§ 371 (c)(1),
(2) Date: Apr. 25, 2017

(87) PCT Pub. No.: WO2016/062321
PCT Pub. Date: Apr. 28, 2016

(65) Prior Publication Data

US 2017/0241146 A1 Aug. 24, 2017

(30) Foreign Application Priority Data

Oct. 25, 2014 (EE) ..... 201400037

(51) Int. Cl.
*B05C 11/00* (2006.01)
*E04F 21/165* (2006.01)
(Continued)

(52) U.S. Cl.
CPC .... *E04F 21/1652* (2013.01); *B05C 17/00503* (2013.01); *B05C 17/00596* (2013.01); *B05C 17/10* (2013.01); *B05C 17/01* (2013.01)

(58) Field of Classification Search
CPC ..... E04F 21/1652; B05C 17/00503; B05C 17/00596; B05C 17/10
(Continued)

(56) References Cited

U.S. PATENT DOCUMENTS 5,346,380 A 9/1994 Ables
5,865,555 A * 2/1999 Dawson ..... B05B 15/00 222/23
(Continued)

FOREIGN PATENT DOCUMENTS

DE 3217152 A1 11/1983
DE 19646352 A1 5/1998
(Continued)

*Primary Examiner* — Jennifer C Chiang
(74) *Attorney, Agent, or Firm* — Berggren LLP

(57) ABSTRACT

A device suitable for finishing and sealing the joints and openings of different surfaces is described here. The device includes a base, which is conical in its essence. The base has a collar to connect the device to the gun of sealant of finishing material; a holder is integrated with the base at an angle, a movable smoothing pad with a carriage is fitted in the holder, and the carriage is installed in a casing inside holder. In the working position, there is a space between the smoothing pad and the tip of the nozzle of the tube, so that the material which is applied from the tube to the surface can visually be monitored and thus the desirable quantity dosed during the performance of the works.

11 Claims, 8 Drawing Sheets

(51) Int. Cl.
*B05C 17/005* (2006.01)
*B05C 17/10* (2006.01)
*B05C 17/01* (2006.01)

(58) Field of Classification Search
USPC ..... 401/266
See application file for complete search history.

(56) References Cited

U.S. PATENT DOCUMENTS

| | | | | |
|---|---|---|---|---|
| 8,308,389 | B2 * | 11/2012 | Yu | E04F 21/1655 118/44 |
| 2006/0231964 | A1 | 10/2006 | Woods | |
| 2011/0271477 | A1 | 11/2011 | Lien | |
| 2012/0180718 | A1 | 7/2012 | Martin | |

FOREIGN PATENT DOCUMENTS

| | | | |
|---|---|---|---|
| DE | 10053066 | A1 | 4/2002 |
| DE | 102011076412 | A1 | 11/2012 |
| EP | 2547457 | A1 | 1/2013 |
| EP | 2571627 | A1 | 3/2013 |
| GB | 2507275 | A | 4/2017 |
| SI | 1666683 | T1 | 6/2009 |
| WO | 2012150471 | A1 | 11/2012 |

* cited by examiner

DEVICE FOR SMOOTHING OF VISCOSE BUILDING MATERIAL

PRIORITY

This application is a U.S national application of the international application number PCT/EE2015/000003 filed on Apr. 30, 2015 claiming priority of the Estonian national application number P201400037 filed on Oct. 25, 2014, the contents of both of which are incorporated herein by reference.

FIELD OF THE INVENTION

The invention is related to the field of construction. More specifically, it relates to a device that is suitable for finishing and sealing the joints and gaps between different surfaces.

BACKGROUND OF THE INVENTION

The purpose of the device is to accelerate and facilitate the work processes when applying acrylics, silicones or performing similar works. In the final stages of painting or sanitary works, many corners (between walls and ceilings and walls), the edges of openings, gaps, etc. need to be filled with a suitable sealant, which is an acrylic, silicone or other viscous material. In the performance of these works, a corner or gap is first filled with a suitable viscous material and then smoothed with a finger. Using the device of the invention, these works can be completed in a single operation. With the help of the device of the invention, work is faster, more convenient, and of higher quality.

STATE OF THE ART

GB2507275 discloses a tool that comprises a body, which has an edge for smoothing sealants, and two arms on both sides of the body. The arms are integrated with the body and can be bent away from the body or closer to it. The arms form a space where excess sealant material can be gathered. The edge may be curved or even.

EP2571627 discloses an applicator for sealants comprising a feed tube with a supply side, a tubular feed part and an outflow side, wherein the outflow side comprises a nozzle; a wiping blade fixedly connected to the outflow side of the feed tube. The upper surface of the wiping blade comprises an inner surface bounded by two upright dikes that together form a wiping edge for applying and wiping sealant coming from the nozzle.

EP2547457 discloses a sealant contour forming tool, comprising an elongate substantially cylindrical body having an open front end and an open rear end. The shape of the opening in the housing can be changed by pressing it and thus forming a sealant contour with the necessary profile during the performance of works.

DE19646352 discloses a tool that has a nozzle fitted on the end of a sealant tube by means of, e.g. a spherical join. The shoe around the nozzle has a longitudinal groove for forming the shape of sealants.

US 2011271477 discloses a finger-shaped tool that imitates the shape and functions of a human finger. The tool has an elongated housing for an applicator and an inner support of the housing. The housing has an applicator part and a handle part. When force is applied on the upper part of the housing, this force is evenly transferred to the surface of the applicator part, which allows one to spread and smooth a sealant.

SI1666683 discloses a tool for finishing and smoothing permanently elastic sealant joints.

DE10053066 discloses a device made of wood or plastic that has one or more faces of different dimensions and at different angles, which make up a smoothing edge and the extensions thereof.

WO2012150471 discloses a tool for the application of materials such as sealants or other relatively viscous materials to surfaces. The tool has a housing with a through opening, which the applied sealant passes through. The tool has an arm part, which extends outwards from the housing and contains a brushing edge or surface as well as a collection surface. The tool is constructed so that the brushing edge or surface brushes over the surface of the substrate to collect any excess material against the collection surface.

The solutions known from the state of art lack some of the functions that have been set as the objective of this invention, such as the option of changing only the smoothing nozzle, the preadjustment of the angle of inclination of the smoothing nozzle, adjustment of the distance between the smoothing nozzle and the sealant passing through the tube, and the harmonisation and conformance of the individual device with the tube dimensions of sealants available on the market. The objective of the invention could not be solved by the combination of the features of the existing solutions.

SUMMARY OF THE INVENTION

The objective of the invention is to provide a device for smoothing silicones, sealants or other viscous materials that are applied to the joints or gaps between surfaces as well as for the collection and removal of any excess material. The device of the invention consists of a base, in the preferred embodiment a conical pipe, which is intended for connecting the device to the nozzle of a tube of silicone, a sealant or other viscous material. Alternatively, the conical pipe is formed in two parts, so that one part of the pipe is fixedly connected to a gun and the other part is connected to the nozzle of a tube which is filled with silicone, a sealant or similar viscous material. A slide rod adjustable in relation to the base is attached to the base and a replaceable smoothing pad is fixed to the slide rod. The base is preferably fixed to the nozzle of the tube with a thread. The smoothing pad is connected to the slide rod in a way that enables finding a suitable location for the smoothing pad on the slide rod with fixed positions.

LIST OF DRAWINGS

A more thorough understanding of the invention can be attained by reading the following detailed description of the preferred embodiment in conjunction with the accompanying drawings, wherein.

AN EXAMPLE EMBODIMENT OF THE DEVICE

Figure 1:
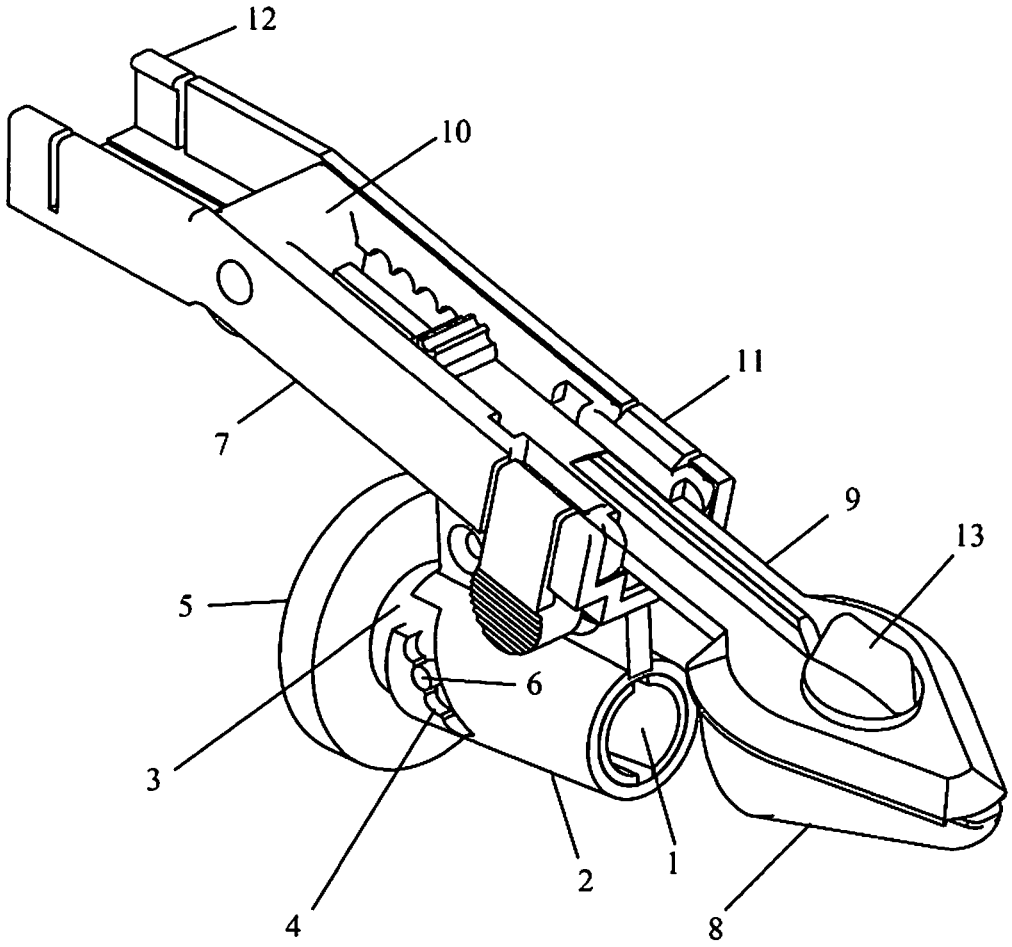
FIG. 1 is a general view of a preferred embodiment of the device of the invention.
Figure 2C:
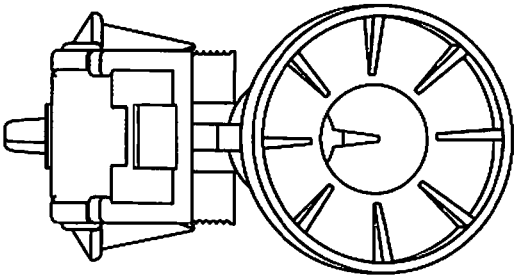
FIG. 2C is an end view of the device from the side of a silicone gun.
Figure 2A:
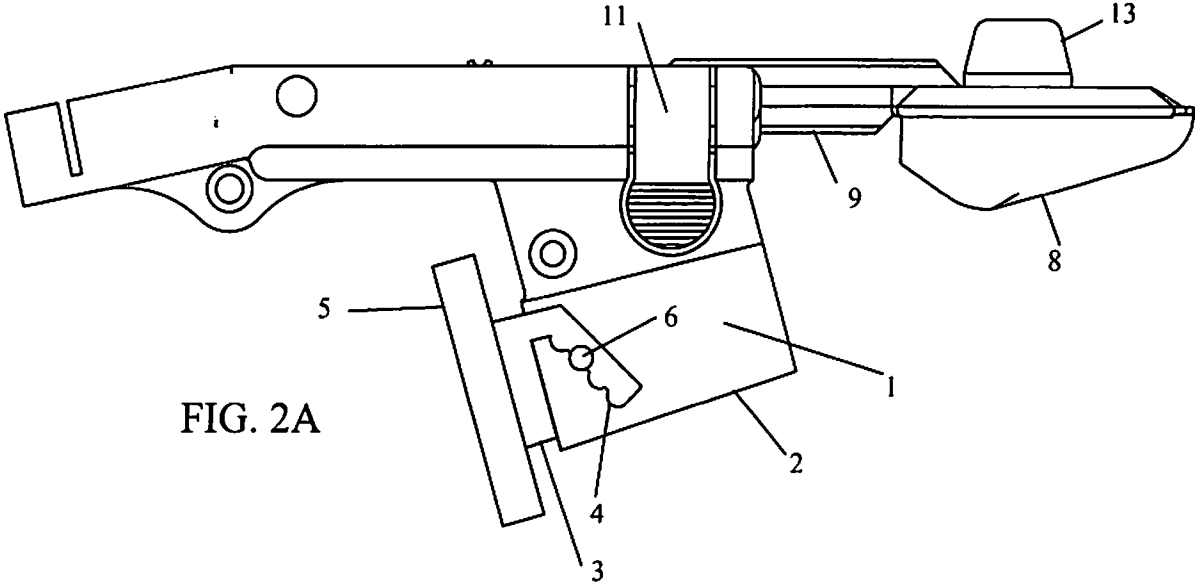
FIG. 2A is a side view of the device.
Figure 2B:
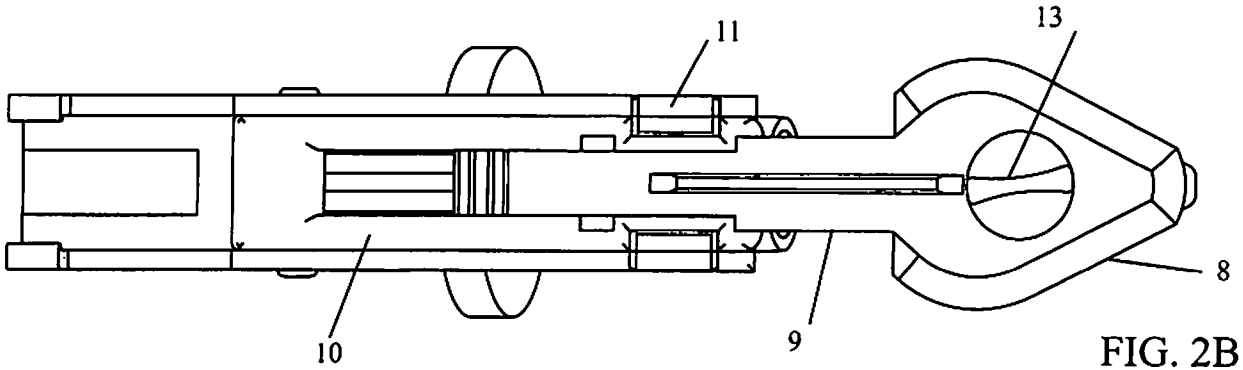
FIG. 2B is a top view of the device.
Figure 9:
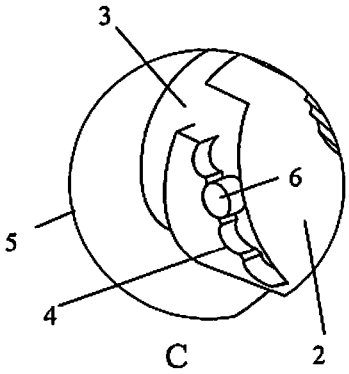
FIG. 9 is an enlarged view of detail C in FIG. 6.

Base 1 (see FIG. 1, FIG. 2A) in the preferred embodiment is a conical pipe for attachment to the end of a silicone cartridge or attachment to the end of a silicone cartridge with an extra mount to a silicone gun. In the preferred embodiment, base 1 is made up of two conical parts that fit in each other, an external part 2, and an internal part 3. The remaining components of the device are attached to the external part. The external part has a stepped cut 4 at the wider end of the cone (see FIG. 9 for more details). The internal part 3 has a pin 6 in the collar 5 area with cuts matched to the steps 4. The pin 6 is movable along the stepped cut by rotating the internal and external part in relation to each other. When the internal and external parts are rotated in one direction, the connection between the internal and external part can be tightened; by rotating the internal and external part in an opposite direction, the parts can respectively be separated from each other. The internal part may have one or more cuts in the area of the narrower part of the cone in the longitudinal direction, which makes it possible for the diameter of the narrower part of the internal part to change if the internal part moves deeper into the external part. This makes it possible to adjust the device to the nozzles of silicone cartridges of different shapes. In an alternative embodiment, the internal part may have an internal thread for fixing the device to the nozzle of a silicone cartridge.

Figure 4:
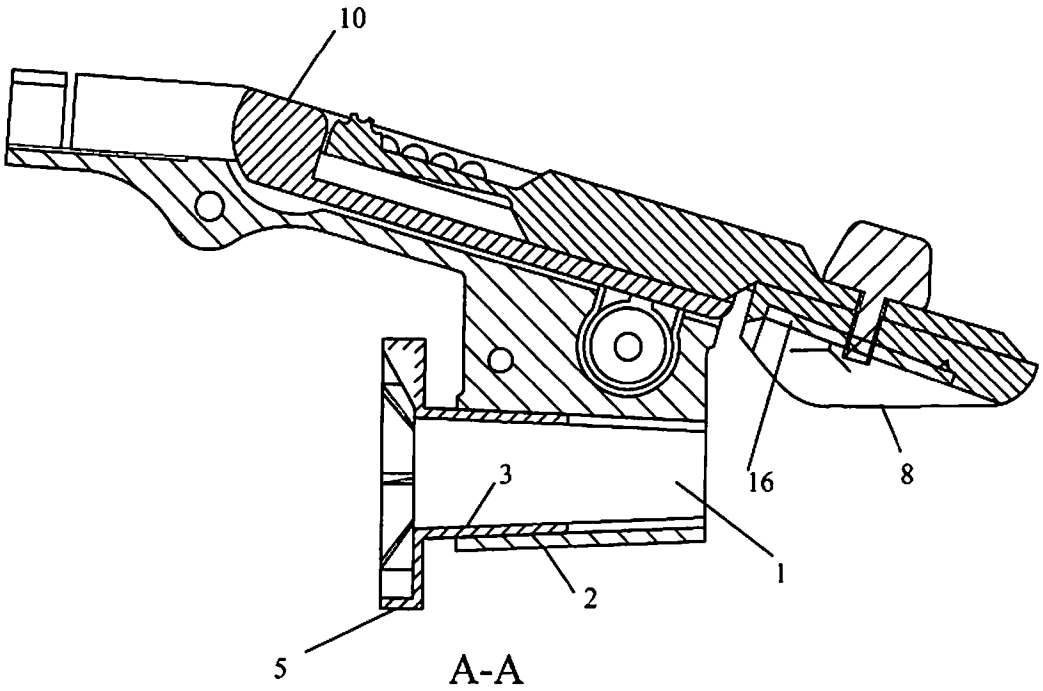
FIG. 4 is a sectional view along the line A-A in FIG. 3.
Figure 3:
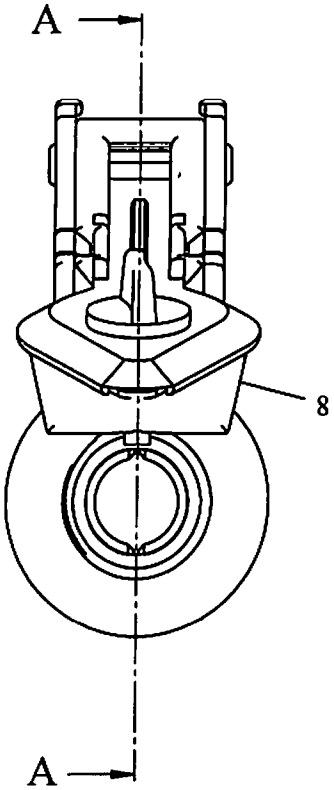
FIG. 3 is an end view of the device from the side of the smoothing pad.
Figure 5C:
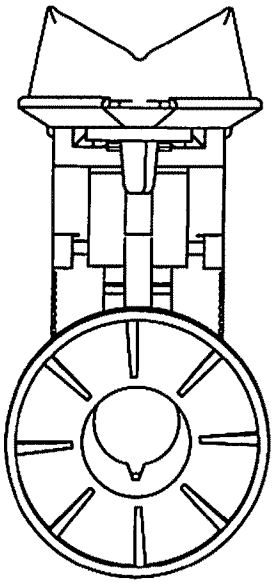
FIG. 5C is an end view of the device with the smoothing pad reversed from the working position.
Figure 5A:
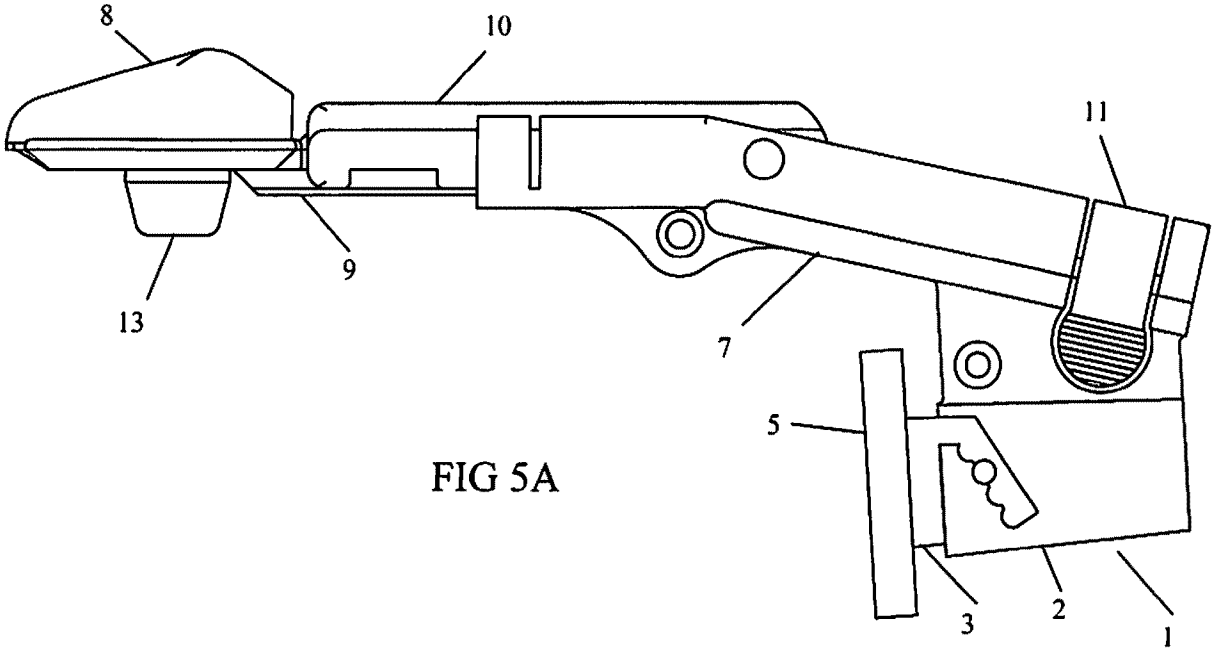
FIG. 5A is a side view of the device with the smoothing pad reversed from the working position.
Figure 5B:
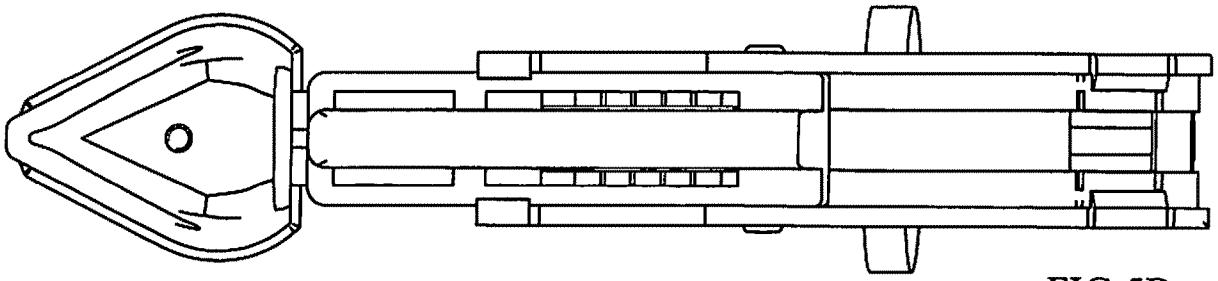
FIG. 5B is a top view of the device with the smoothing pad reversed from the working position.
Figure 6:
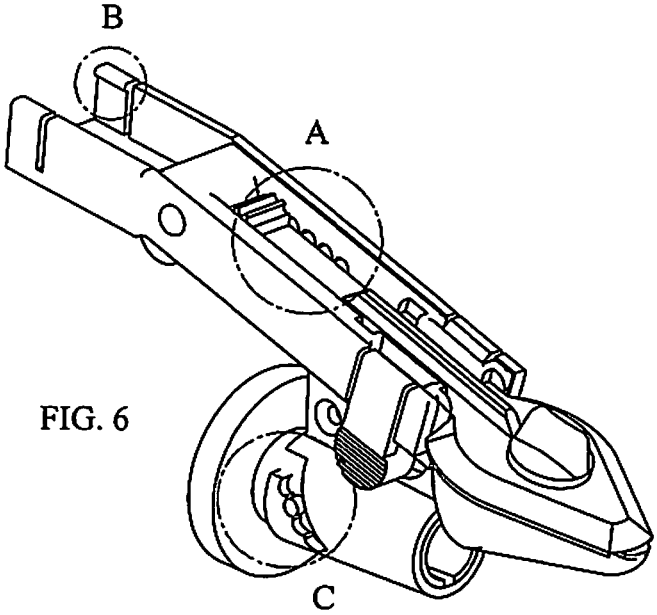
FIG. 6 is a general view of a preferred embodiment of the device of the invention, indicating the enlarged views of certain details of the device.
Figure 8:
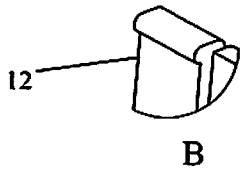
FIG. 8 is an enlarged view of detail B in FIG. 6.
Figure 7:
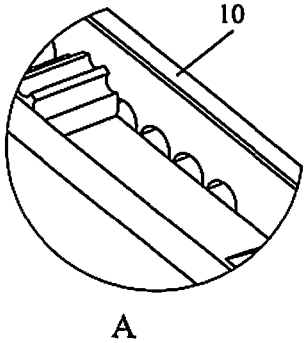
FIG. 7 is an enlarged view of detail A in FIG. 6.
Figure 11:
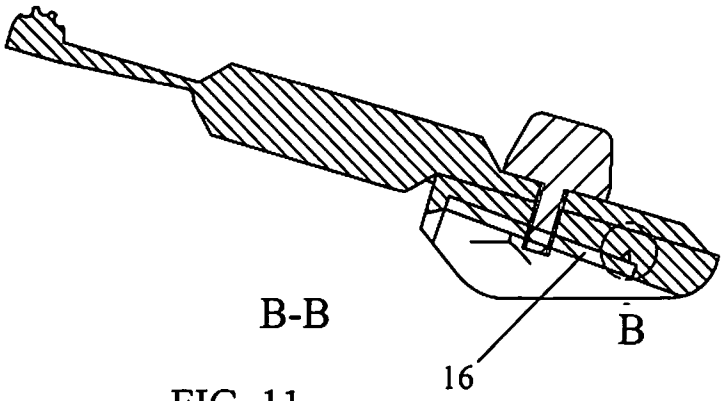
FIG. 11 is a sectional view along the line B-B in figure FIG. 10.
Figure 12:
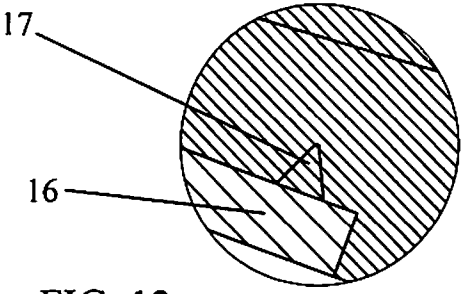
FIG. 12 is an enlarged view of detail D in FIG. 11.
Figure 10:
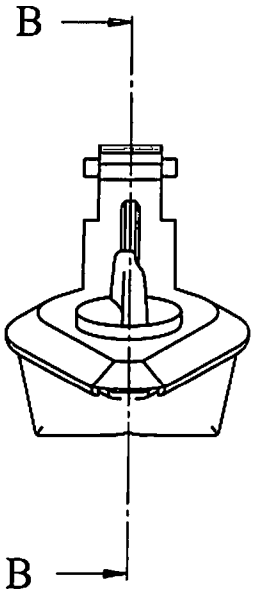
FIG. 10 represents an end view of the carriage of the device and the smoothing pad attached to it.
Figure 14C:
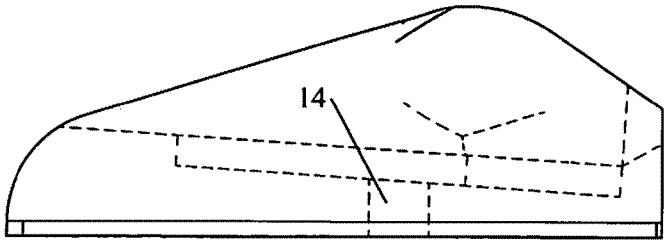
FIG. 14C is a side view of the smoothing pad of the device.
Figure 13:
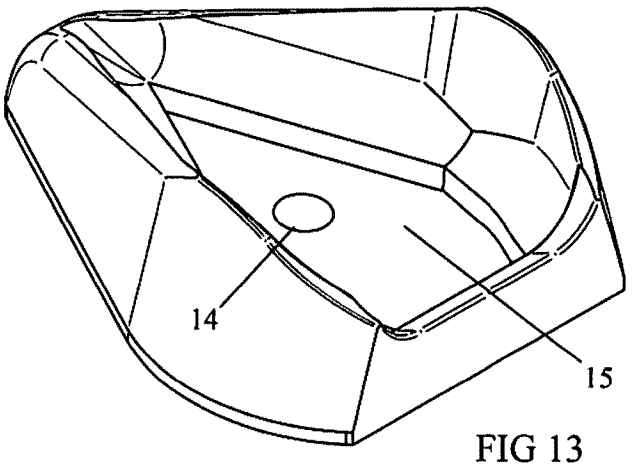
FIG. 13 is a general view of the smoothing pad of the device.
Figure 14B:
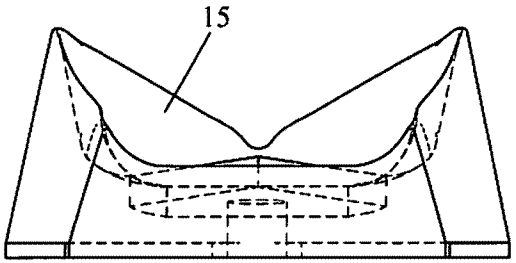
FIG. 14B is an end view of the smoothing pad of the device.
Figure 14A:
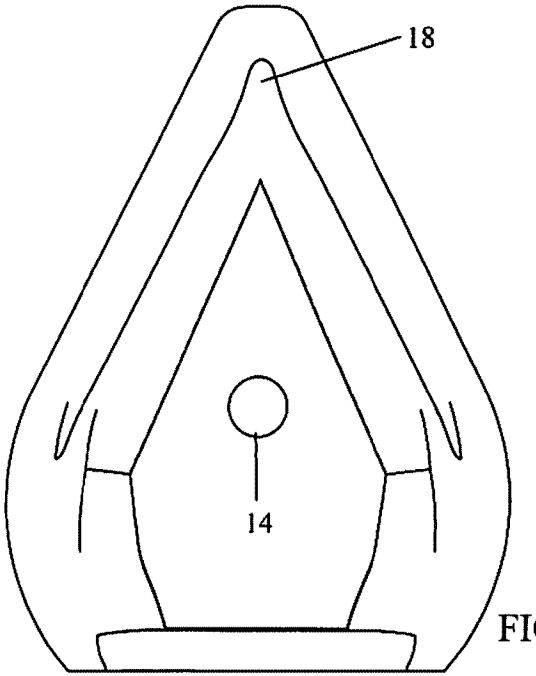
FIG. 14A is a bottom view of the smoothing pad of the device.
Figure 17:
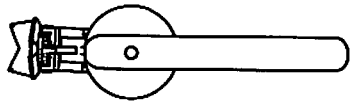
FIG. 17 is an end view of the device attached to a silicone gun and cartridge, its smoothing pad reversed from the working position.
Figure 18:
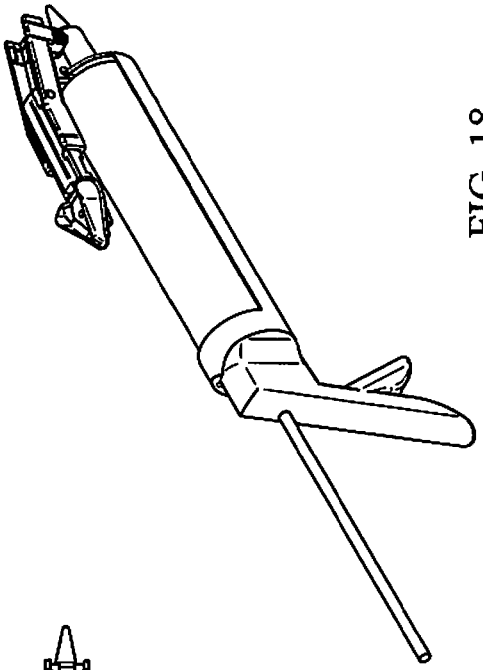
FIG. 18 is a general view of the device attached to a silicone gun and cartridge, its smoothing pad reversed from the working position.
Figure 15:
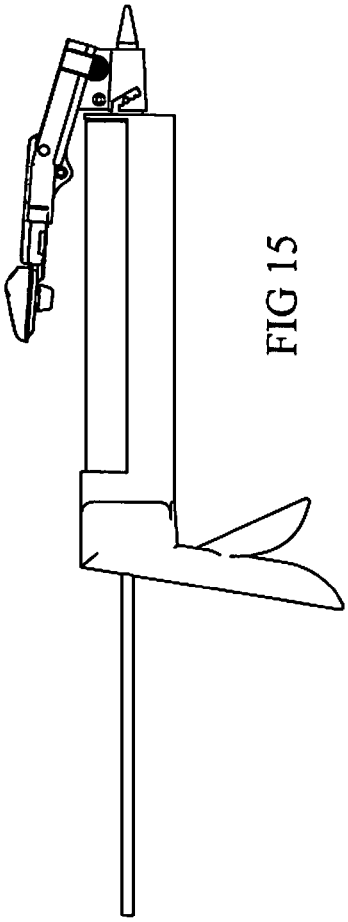
FIG. 15 is a side view of the device attached to a silicone gun and cartridge, its smoothing pad reversed from the working position.
Figure 16:
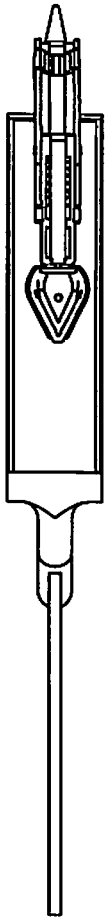
FIG. 16 is a top view of the device attached to a silicone gun and cartridge, its smoothing pad reversed from the working position.

A groove-shaped holder 7 is connected to base 1 of the device at an angle. The groove-shaped holder 7 is designed for fixing the working position of the smoothing pad 8. The groove of the groove-shaped holder 7 holds the casing 10 of the carriage 9 of the smoothing pad 8. The carriage 9 can be moved back and forth inside the casing 10 in the manner known from the state of art, such as the well-known movement of the blade of a carpet knife inside its housing (see the detail in FIG. 7). The casing is connected to the groove-shaped holder 7 with a joint at one end, so that the casing 10 together with the carriage of the smoothing pad 8 inside it can be rotated outwards from the groove-shaped holder and moved to a reversed position (see figures FIG. 5A-5AC). In the working position, the casing 10 is fixed inside the groove-shaped holder 7 with locking devices 11. In its reversed position, the casing 10 is fixed with the retainers 12 at the ends of the groove-shaped holder 7 (a more detailed view is provided in figure FIG. 8). Bringing the smoothing pad 8 to a reversed position is necessary for forming the corners of the room that is being finished, for example, because otherwise the smoothing pad would obstruct the application of silicone or other elastic sealants to the corners. In the preferred embodiment, the smoothing pad 8 is attached to the end of the carriage 9 with a butterfly bolt 13 that extends through the opening 14 in the smoothing head. The counter side of the bolt is a plate 16 (see FIGS. 4, 11, 12) received by the cavity 15 (see FIGS. 13, 14A, 14B, 14C) of the bottom side of the smoothing pad. The plate has a threaded opening for receiving the bolt 13. In addition, the plate 16 has a tip 17 designed to be pushed into the smoothing pad to fix the smoothing pad 8 more rigidly to the carriage 9. The face of the smoothing pad 8 has a surface with the shape of a fingertip, which has a cavity 15 in the bottom side for the collection of excess finishing materials or sealants during the smoothing operation. The cavity 15 extends to the back of the smoothing pad; the cavity has a protruding pouch 18 at the end of the narrower part of the smoothing pad. A collection spoon (not shown in the figures) may be provided for the collection of any viscous material accumulated in the cavity 15.

In brief, the work procedure using the device is as follows. The device is connected to a gun for silicone, acrylics or other viscous material by the use of base 1. The casing 10 with the carriage of the smoothing pad 8 is rotated out of the groove-shaped holder and moved to a reversed position (see FIG. 5A-5C, FIG. 15-18). The tip of the tube of silicone, acrylics or other viscous material is then placed in the corner that is to be treated or finished, and the corner part is first completed. The casing 10 is then rotated to the working position together with the carriage 9 of the smoothing pad 8 held in the casing and the smoothing pad 8; the casing is fixed with the locking devices 11 after which material can be applied to corner joints of the walls or the ceiling of the room.

The invention claimed is:

1. A device for smoothing viscous construction materials, the device consisting essentially of:

a base comprising a collar and a tubular cone;

the tubular cone being formed of an external conical part and of an internal conical part fitting inside the external conical part;

the collar being attached to wider end of the internal conical part and configured to attach the tubular cone to a nozzle and gun of a tube filled with the viscous material;

the external conical part having a stepped cut at its wider end, and the internal conical part having a pin configured to fit in the cut of the external part; and a holder integrated with the base at an angle and comprising a carriage having replaceable and adjustable smoothing pad and being movably arranged on the holder; wherein moving the carriage on the holder moves the pad closer to and further away from the nozzle such that a space is left between the smoothing pad and the nozzle to visually monitor quantity of material applied from the tube and dose a desired quantity.

2. The device of claim 1, wherein the integrated holder is essentially groove-shaped.

3. The device of claim 1, wherein the carriage of the smoothing pad is connected to the holder by means of a casing that can be rotated outwards from the holder.

4. The device of claim 3, wherein in its working position, the casing of the carriage is fixed to the groove-shaped holder with two locking devices.

5. The device of claim 3, wherein the carriage can be moved back and forth in the casing to fixable positions.

6. The device of claim 1, wherein the smoothing pad is a silicone pad.

7. The device of claim 1, wherein the smoothing pad has a fingertip-shaped surface with a broader and a narrower end.

8. The device of claim 7, wherein the smoothing pad has a cavity for collection of excess viscous material, and the cavity has a protruding pouch at the narrower end of the smoothing pad.

9. The device of claim 1, wherein the smoothing pad is removably connected to the carriage.

10. The device of claim 1, wherein the smoothing pad is connected to the carriage with a butterfly bolt that extends through the carriage and the smoothing pad, and wherein the bolt is screwed in a threaded opening of a plate inside a cavity in a bottom side of the smoothing pad.

11. The device of claim 10, wherein the plate in the bottom side cavity of the smoothing pad has a protruding tip at one end, which is pressed inside the smoothing pad in order to ensure a rigid connection between the smoothing pad and the carriage.

* * * * *